US005885063A

United States Patent [19]

Makino et al.

[11] Patent Number: 5,885,063

[45] Date of Patent: Mar. 23, 1999

[54] VARIABLE CAPACITY SCROLL COMPRESSOR

[75] Inventors: Masahiko Makino, Hashimoto; Akihiko Shimizu, Kusatsu; Tatsuhisa Taguchi, Katano; Daisuke Ito, Meyagawa, all of Japan

[73] Assignee: Matshushita Electric Industrial Co., Ltd., Osaka, Japan

[21] Appl. No.: 805,548

[22] Filed: Feb. 25, 1997

[30] Foreign Application Priority Data

May 7, 1996 [JP] Japan ..... 8-112488

[51] Int. Cl.[6] ..... F04B 49/00

[52] U.S. Cl. ..... 417/310; 417/410.5

[58] Field of Search ..... 417/310, 410.5

[56] References Cited

U.S. PATENT DOCUMENTS 4,890,987 1/1990 Sato et al. ..... 417/310

5,639,225 6/1997 Matsuda et al. ..... 417/310

*Primary Examiner*—Timothy Thorpe
*Assistant Examiner*—Cheryl J. Tyler
*Attorney, Agent, or Firm*—Amster, Rothstein & Ebenstein

[57] ABSTRACT

A variable capacity control scroll compressor, including: a cylinder disposed in the end plate of the fixed scroll incorporating a reciprocating shuttle valve to selectively enable fluid passage through a first group of bypass holes communicating with a pair of fluid pockets in a given compression stroke, and further through a second group of bypass holes communicating with a single fluid pocket as the pair of fluid pockets merge into one pocket during compression, sequential opening and closing of these bypass holes being controlled by a pressure control valve administering a control pressure Pm to operate the shuttle valve, the control valve being provided in the fixed end plate such that all of the control mechanism components are integrated into a single structure to reduce fabrication costs and enhance control efficiency.

12 Claims, 5 Drawing Sheets

VARIABLE CAPACITY SCROLL COMPRESSOR

FIELD OF THE INVENTION

The present invention relates to improvements in scroll compressors, and more particularly, to an improved variable capacity scroll compressor of the type used in automotive air-conditioners.

BACKGROUND OF THE INVENTION

In scroll compressor applications, particularly those in automotive environments, the rotational speed of the compressor and cooling load will vary over a wide operating range. Consequently, it is desirable to provide a configuration which maintains the discharge capacity constant irrespective of drive speed, and which evenly changes the discharge capacity as required by the cooling system. To meet these objectives, several approaches have been taken in the prior art.

A conventional variable capacity control type scroll compressor having a valve mechanism for opening and closing a plurality of bypass holes is disclosed in U.S. Pat. No. 5,451,146. That reference teaches a plurality of bypass holes that are disposed in side-by-side relationship through an end plate of a fixed scroll and communicate with the interior bypass passage of an elongated cylinder formed in the end plate. The bypass holes may be selectively opened to the bypass passage with a reciprocating plunger, to enable fluid bypass to a suction chamber formed in the housing. A control valve mechanism for opening and closing the bypass passage is located in the rear housing of the compressor. This structure has a disadvantage in that the arrangement of the bypass holes is asymmetric with respect to the fluid pockets undergoing compression, resulting in an unbalanced operating condition, reduced efficiency and greater noise.

Another variable capacity scroll compressor is disclosed in U.S. Pat. No. 5,074,760. This patent teaches a pair of bypass control valve mechanisms that control fluid bypass through bypass ports that are located symmetrically with respect to the fluid pockets being compressed. Another bypass hole is positioned proximal to the discharge port to enable the capacity control to range from 0 to 100%.

Yet another example of a variable capacity compressor is disclosed in Japanese Laid-open Patent 5-280476, wherein a cylinder having a coaxial, internally disposed valve plunger for sequentially closing a plurality of bypass holes communicating between the cylinder and a compression chamber is located in the end plate of the fixed scroll.

The structural configurations taught in the aforementioned prior art have several disadvantages. These include the relatively large number of parts and steps required during assembly resulting from utilizing numerous variable capacity components, thereby increasing the cost and weight of the overall assembly.

The variable capacity configurations taught in the '146 Patent and the Japanese Laid-open '476 Patent both have a disadvantage in that the bypass holes are opened asymmetrically (i.e., different positions) with respect to a pair of fluid pockets in the same compression stroke, thereby causing an uneven pressure balance, reduced efficiency and increased noise and vibration. In this regard, during high speed rotation, the bypass gas flow from the bypass hole communicating with the fluid pocket at the upstream side increases, and compressed gas is not fully returned to the suction chamber. Such gas flows partially back into the bypass hole communicating with the downstream side fluid pocket, causing increased pressure losses and reduced performance. Although the structure shown in the '760 Patent alleviates these problems, it utilizes multiple bypass valve assemblies to do it, consequently increasing manufacturing costs and lowering reliability.

SUMMARY OF THE INVENTION

In view of the above-described shortcomings of the prior art variable capacity scroll compressors, it is an object of the present invention to provide a variable capacity scroll compressor of high control efficiency capable of smoothly changing the discharge capacity or maintaining a constant discharge capacity under varying operating conditions in a simple and compact structure.

It is another object of the present invention to provide a variable capacity scroll- compressor utilizing a single shuttle valve mechanism while symmetrically effecting fluid bypass to the suction side of the compressor.

It is another object of the present invention to provide a variable capacity scroll compressor which prevents backflow of compressed fluid bypassed from the upstream side fluid pocket to the bypass holes communicating with the downstream side fluid pocket to completely bypass such fluid to the suction chamber.

It is still another object of the present invention to provide a variable capacity scroll compressor having a shuttle and control valve mechanism disposed in the fixed end plate of the fixed scroll to simplify assembly and reduce manufacturing costs.

In accordance with the above objects and additional objects that will become apparent hereinafter, the present invention provides an improvement in a variable capacity control scroll compressor comprising: a compressor housing; a fixed scroll having a fixed end plate and a spiral wrap extending from the fixed end plate; an orbiting scroll having an orbiting end plate defining a back side and a front side, the front side having an upstanding spiral wrap extending from the orbiting end plate, the wraps of the fixed scroll and the orbiting scroll being intermeshed to define a plurality of fluid compression pockets and being positioned to receive fluid to be compressed from a suction chamber, the fixed scroll and the orbiting scroll being disposed inside of the compressor housing; means for imparting orbiting motion to the orbiting scroll relative to the fixed scroll; anti-rotation means for preventing rotation of the orbiting scroll when the orbiting scroll orbits relative to the fixed scroll; wherein the scroll compressor compresses a working fluid from the outer circumference of both of the wraps inwardly towards a discharge port in the fixed end plate while forming a closed fluid pocket between the wraps by the orbiting motion of the orbiting scroll.

The improved variable capacity mechanism comprises: at least a pair of fluid bypass holes defined through the fixed end plate and positioned with respect to the spiral wrap extending from the fixed end plate to enable communication with at least a certain pair of fluid pockets being compressed simultaneously at equal positions with respect to the shape of the fluid pockets; a single axially elongated cylinder formed in the end plate and adapted to communicate with the fluid pockets through the bypass holes, respectively; a reciprocating shuttle valve slidably disposed in the cylinder to thereby vary the opening area of the bypass holes to continuously change the discharge capacity of the scroll compressor by communicating compressed fluid back to the suction chamber, the shuttle valve being spring-loaded with respect to a second side thereof such that shuttle valve translation within the cylinder is effected by a net force applied to the shuttle valve as a result of a control pressure Pm and the spring-loading, wherein the shuttle valve has an outer circumference and at least one recess defined in the outer circumference, the shuttle valve further defining a fluid passageway therein communicating fluid through the shuttle valve from the at least one recess via at least one port defined in the at least one recess of the shuttle valve, the fixed end plate defining a passageway for communicating between the suction chamber and the fluid passageway in the cylinder; and a control valve for supplying a control pressure Pm to the shuttle valve to enable operation thereof in response to variations is suction pressure Ps, the control valve being integral with the fixed end plate wherein the control valve communicates the control pressure Pm to the shuttle valve via a passageway defined in the cylinder such that the control pressure is applied to a first side of the shuttle valve.

In a preferred embodiment, a first recess is located relative to the shuttle valve proximal to a first group of bypass holes defined in the fixed end plate and the second recess is located relative to the shuttle valve proximal to a second group of bypass holes defined in the fixed end plate near the discharge port when the shuttle valve is disposed in a bypass position so as to facilitate fluid bypass through the first and second groups of bypass holes. A third recess is located intermediate the first and second recesses to enable opening at least one bypass hole positioned proximal to the discharge port to enable capacity control in the range of from about 0 to 100%.

The many advantages of the present invention will be better understood as the detailed description thereof proceeds below with particular reference to the accompanying drawings.

DETAILED DESCRIPTION OF THE INVENTION

Referring now to the several views of the drawings, there is shown a variable capacity control scroll compressor in accord with a preferred embodiment of the present invention.

Figure 1:
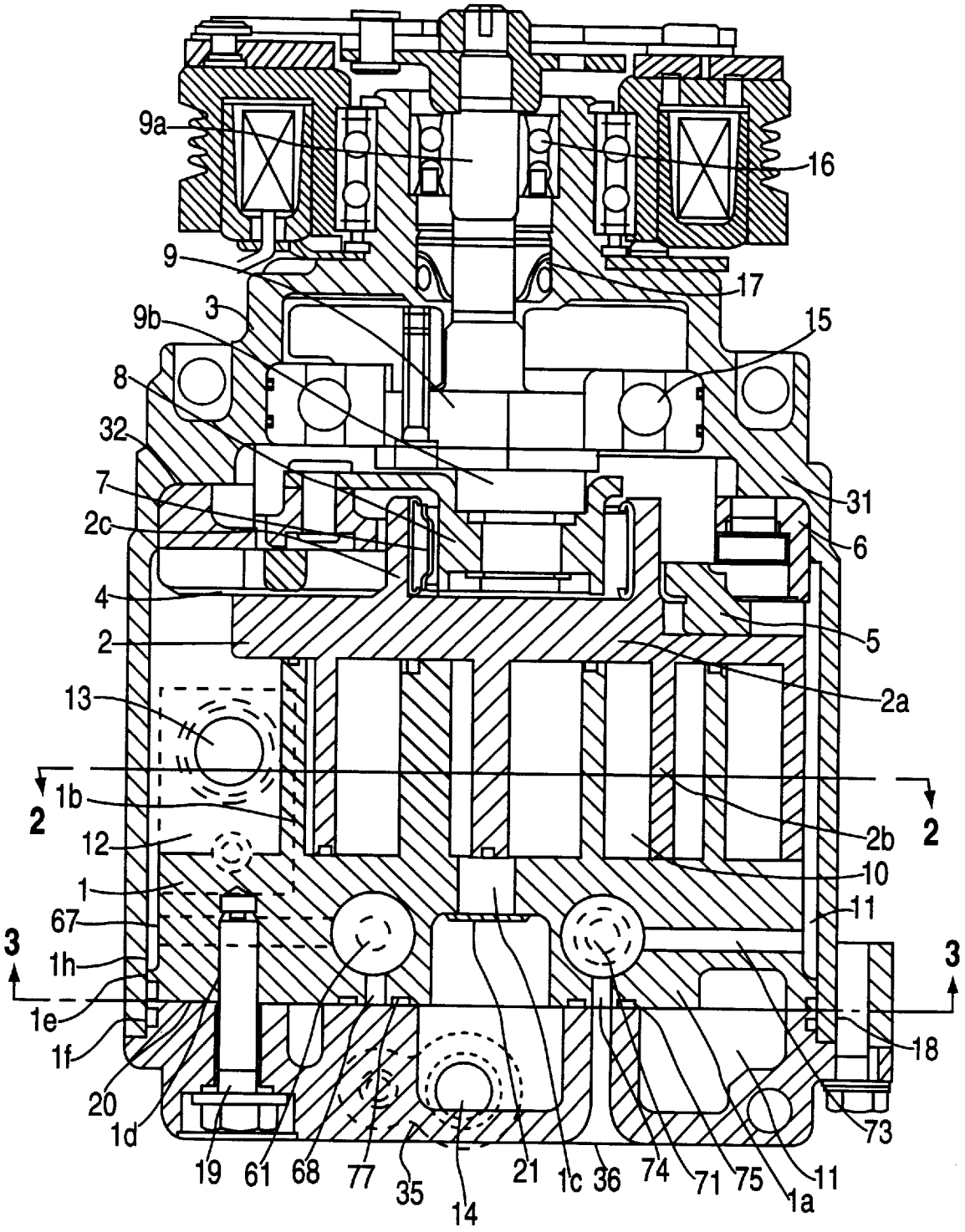
FIG. 1 is a sectional view of a variable capacity control scroll compressor in a preferred embodiment of the invention.

Turning now to FIG. 1, a compressor housing 3 is divided into a front housing 31 and a rear plate 35, and includes an interior chamber comprising a fixed scroll 1 having a fixed end plate 1*a* and an upstanding spiral wrap 1*b* on the fixed end plate 1*a*. An orbiting scroll 2 having an orbiting end plate 2*a* and upstanding spiral wrap 2*b* on the orbiting end plate 2*a* is engagable with the fixed scroll 1, with both wraps 1*b*, 2*b* intermeshed as shown. To provide an orbiting mechanism, a cylindrical boss 2*c* is formed on the back side of the orbiting end plate 2*a* on the opposite side of the spiral wrap 2*b* of the swivel scroll 2, and an orbiting bearing 7 is provided on the boss 2*c*.

A drive shaft 9 is rotatably supported through a main bearing 15 provided in a front housing 31, and a main shaft portion 9*a* projects outside of the front housing 31 through a shaft sealing device 17 and a subsidiary bearing 16. A drive pin 9*b* disposed at the end of the swivel scroll 2 side of the drive shaft 9, is coupled with an orbiting bushing 8 as a drive transmission mechanism inserted in an orbiting bearing 7. A driving force transmitted from the drive shaft 9 applies orbiting motion to the orbiting scroll 2.

Between the orbiting end plate 2*a* and front housing 31, a thrust bearing 4 comprised of a flat plate for supporting the thrust force applied to the orbiting scroll 2 in the axial direction is disposed parallel to the orbiting end plate 2*a*. A motion restricting component 6 is provided for restricting an Oldham ring 5 to moving only along a single direction at a right angle to the drive shaft 9, where the Oldham ring 5 functions as a rotation restraining component for preventing the rotation of the orbiting scroll 2 to permit orbiting motion only.

An O-ring 18 is inserted into a seal groove if on the outer circumference 1*e* of the fixed end plate 1*a* of the fixed scroll 1 and functions as a seal member, partitioning the inside of the compressor housing 3 into a high pressure chamber 11 and a low pressure chamber 12. The fixed scroll 1 and the rear plate 35 form the high pressure chamber 11. They are assembled by tightening a bolt 19 through hole 1*d* provided at the back side of the fixed end plate 1*a*. Compressed fluid exits the high pressure chamber through discharge port 14.

A motion restricting component 6 having a suction port 13 is affixed to a front end portion 32 of the front housing 31 and the orbiting scroll 2 is pressed against the motion restricting component 6 through the thrust bearing 4 by the thrust force. The front housing 31 is closed by the rear plate 35 through a thrust clearance adjusting shim 20 near the outer circumference of the fixed end plate 1*a* of the fixed scroll 1.

As a result of the orbiting motion of the orbiting scroll 2, the refrigerant is introduced into the low pressure chamber 12 through the suction port 13 in the front housing 31 from outside of the compressor housing 3, and is communicated nearly to the outer circumference of wraps 1*b*, 2*b* of the fixed scroll 1 and orbiting scroll 2, respectively.

The orbiting motion of the swivel scroll 2 causes the refrigerant to be sucked into a liquid pocket 10 closed by both wraps 1*b*, 2*b*, and compressed while decreasing in volume from the outer circumference of wraps 1*b*, 2*b* toward the center, and discharged into the high pressure chamber 11 through the discharge gas hole 1*c* of the fixed end plate 1*a*. In the discharge gas hole 1*c*, a discharge valve 21 is fitted from the high pressure chamber 11 side to prevent counter-flow of the discharge gas.

Figure 2:
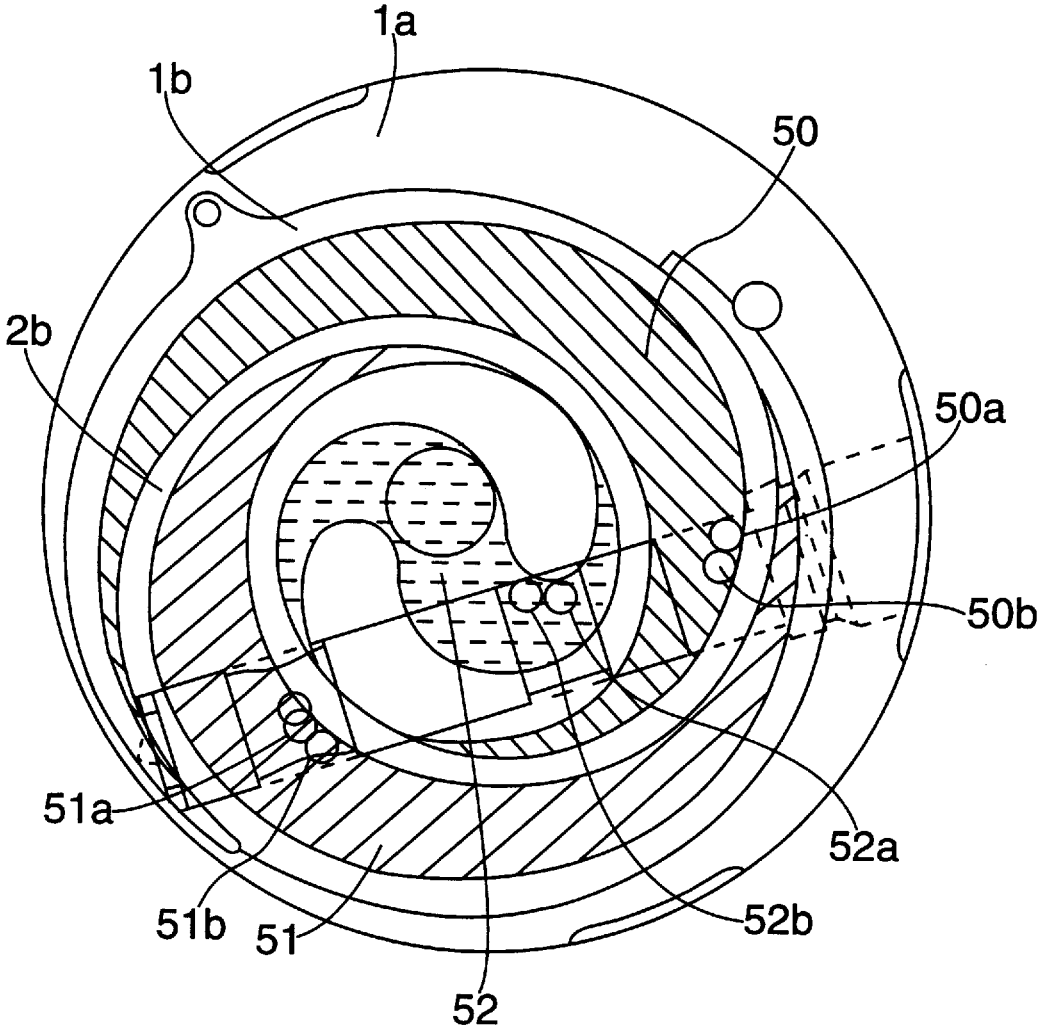
FIG. 2 is a sectional view thereof along line 2—2 in FIG. 1.
Figure 3:
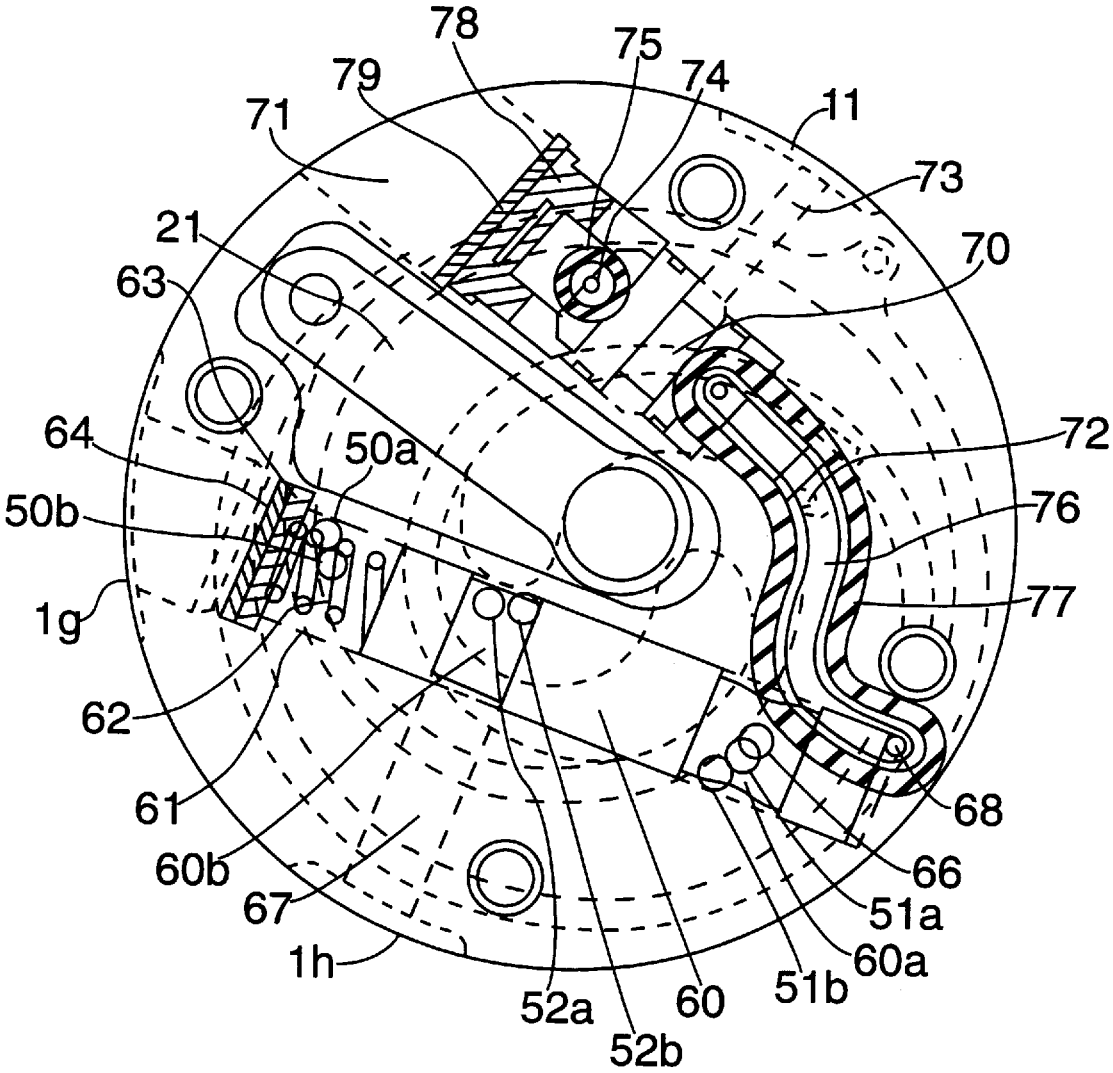
FIG. 3 is a sectional view thereof along line 3—3 in FIG. 1.

The structure of the variable capacity control mechanism is now described with particular reference to FIGS. 2 and 3. Pairs of bypass holes 50*a*, 50*b* and 51*a*, 51*b* are defined in the fixed end plate 1*a* and communicate with a pair of opposed fluid pockets 50 and 51 in the same compression stroke. Bypass holes 52*a*, 52*b* are also defined in fixed end plate 1*a* and communicate with a region in which the pair of fluid pockets merge into one fluid pocket 52 as the compression stroke is further advanced. To close these bypass holes 50*a,* 50*b,* 51*a,* 51*b,* 52*a,* 52*b* sequentially, a shuttle valve 60 is slidably disposed inserted in a cylinder 61 provided in the fixed end plate 1*a*. The shuttle valve 60 is free to reciprocate between a bypass open position and by pass closed position.

One end of the cylinder 61 is opened to a notch 1*g* formed in the outer circumference 1*e* of the fixed end plate 1*a,* and communicates with the low pressure chamber 12. The shuttle valve 60 is biased in the leading end direction by a spring 62, and one end of the spring 62 is maintained in the fixed end plate 1*a* by a holder 63 and a stopper ring 64.

Two recesses 60*a,* 60*b* are formed in the shuttle valve 60. The recess 60*a* is disposed at a position along the shuttle valve 60 so as to communicate with the bypass holes 51*a,* 51*b* when the shuttle valve 60 is urged in the leading end direction. The recess 60*b* is located at a position so as to communicate with the bypass holes 52*a,* 52*b*. In the recess 60*a,* a communication hole 66 is provided to communicate with the low pressure chamber 12 through the inside of the shuttle valve 60. The other recess 60*b* communicates with the low pressure chamber 12 through a passage 67 provided in the fixed end plate and a notch 1*h* formed in the outer circumference 1*e*.

At the leading end of the cylinder 61, a lead-in hole 68 is provided for communicating a control pressure Pm for enabling operation of the shuttle valve 60 by overcoming the biasing force of the spring 62.

A pressure control valve 70 is located in the fixed end plate 1*a* for applying the control pressure Pm to the shuttle valve 60. A control pressure chamber 71, a flow-in hole 72 and a flow-out hole 73 are provided for communicating a intermediate pressure Pc used for controlling the control pressure Pm. The flow-out hole 73 communicates with the low-pressure chamber 12 through a notch 1*i* formed in the outer circumference 1*e* of the fixed end plate 1*a*. The flow-out hole 73 also enables the passage of suction pressure Ps as a low pressure signal.

A communication hole 74 for communicating atmospheric pressure Pa as a base signal is provided in the back side of the fixed end plate 1*a,* and is open to the ambient through an O-ring 75 and a hole 36 provided in the rear plate 35.

The pressure control valve 70 generates an adequate control pressure Pm depending upon the changes of the intermediate pressure Pc and suction pressure Ps. This control pressure Pm flows into the cylinder 61 through a passage 76 formed at the back side of the fixed end plate 1*a* and the lead-in hole 68. The passage 76 is sealed with the rear plate 35 and an O-ring 77.

The operation of the capacity control mechanism is now explained with reference to FIGS. 4 and 5. While the shuttle valve 60 is located at the highest position (the cylinder leading end direction), all bypass holes are fully open and minimum compressor capacity operation is effected. To the contrary, when the shuttle valve 60 is moved to the lowest position, all bypass holes are fully closed and maximum compressor capacity operation is effected.

Figure 4:
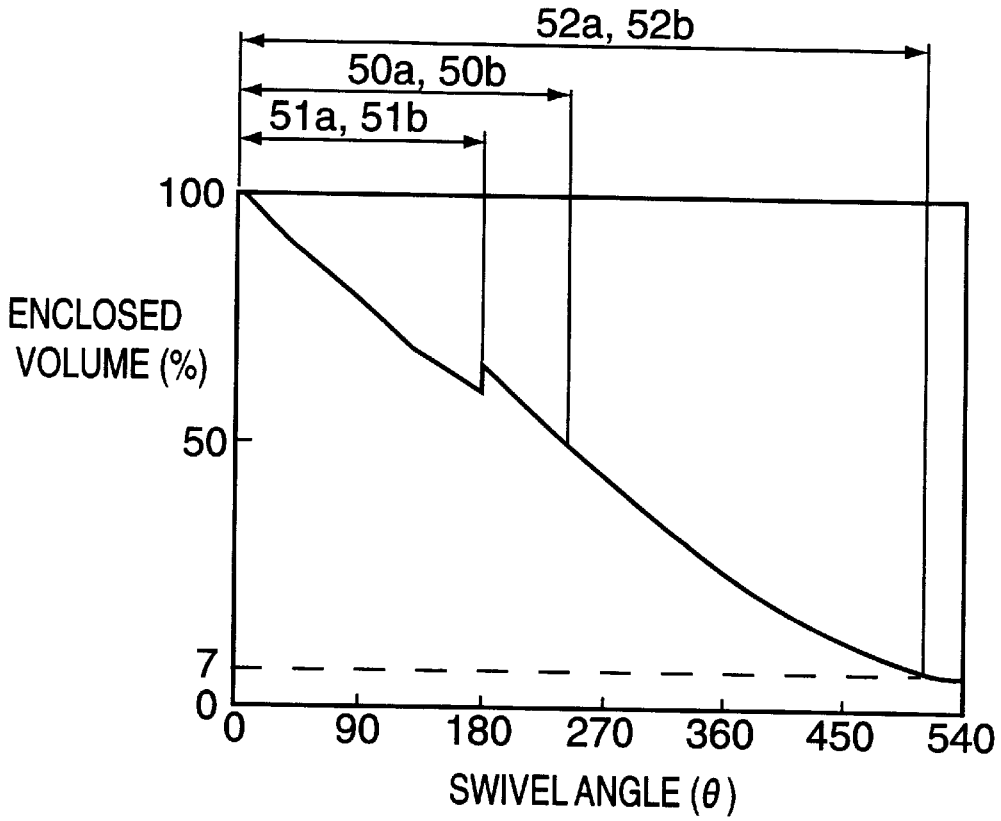
FIG. 4 is a graphical diagram showing the relationship between orbiting angle and enclosed volume in the preferred embodiment.

As shown in FIG. 4, the bypass holes 51*a,* 51*b* communicate with the fluid pockets in the region of maximum compression volume (Vmax) in the range of from about 100% to 60%. The bypass holes 50*a,* 50*b* communicate in the range of from about 100% to 50%, and overlap with the range of the bypass holes 51*a,* 51*b*. The bypass holes 52*a,* 52*b,* when opened further reduce the capacity of the scroll compressor in the range of from about 60% to 7%. The degree to which these bypass holes are opened by the shuttle valve 60, the relationship between the control capacity Vc and shuttle valve stroke Ls is depicted in the graphical representation of FIG. 5. Specifically, bypass holes 50*a,* 50*b* and 52*a,* 52*b* are opened substantially contemporaneously to facilitate even fluid bypass from the opposing fluid pockets undergoing compression. In this manner, operating balance is maintained and noise which can be caused by asymmetrical pressure reduction is prevented. When the compressor is operating at 0% capacity, the shuttle valve 60 is biased by spring 62 into the position depicted in FIG. 3. When a control pressure Pm is introduced into cylinder 61 via lead-in hole 68, the shuttle valve 60 is urged against the force of spring 62, initially causing holes 52*a,* 52*b* to close off and thereby eliminating bypass of high pressure fluid near the discharge port in the single fluid pocket 52. As the control pressure Pm increases, shuttle valve 60 is biased further against spring 62 until bypass holes 50*a,* 50*b* and 52*a* are closed off to enable operation at 100% capacity. The specifics of this process are described hereinafter.

Figure 5:
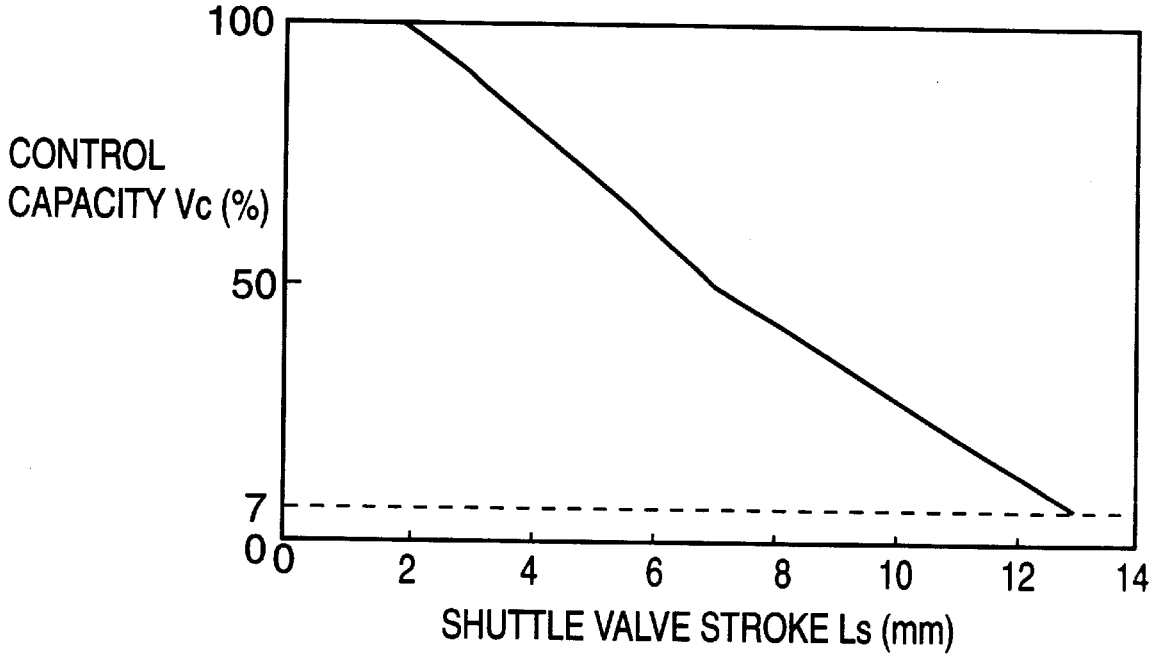
FIG. 5 is a graphical diagram showing the relationship between shuttle valve stroke and control capacity in the preferred embodiment.

In FIG. 5, the control capacity Vc (on the ordinate axis) denotes the ratio in % of the enclosed volume in control as compared with the maximum enclosed volume of the compressor. Ls=0 [mm] (on the ordinate abscissa) shows the state of the shuttle valve 60 located at the lowest position From Ls=0 [mm] to Ls=7 [mm], the bypass holes 50*a,* 51*a,* 50*b,* 51*b* are opened sequentially to effect variable capacity control in the range up to about 50%. After Ls=7 [mm], the bypass holes 52*a,* 52*b* are opened sequentially, and when the shuttle valve 60 reaches the highest position (Ls=13 [mm]), compressor operation is effected at about 7% capacity. With regard to the bypass holes 52*a,* 52*b* as mentioned above, since the bypass passages are independent, the bypass gas will not flow back to the downstream side bypass holes (50*a,* 51*a,* 50*b,* 51*b*), so that the compressor capacity can be controlled without reducing the control efficiency.

The operation of the shuttle valve 60 is described below by using the following symbols:

spring constant of spring 62 is "k";

initial deflection of spring 62 is "Xϕ";

maximum stroke of shuttle valve 60 is "X1" (=13 [mm]); and sectional area of cylinder 61 is "Sv".

Accordingly, with regard to the force acting on the shuttle valve 60, the force Fp for moving the shuttle valve 60 downward by control pressure Pm is Fp=(Pm−Ps)×Sv, and the force Ps for moving the shuttle valve 60 upward by the spring 62 is Fs=k * (Xϕ+X1−Ls).

Therefore, when the shuttle valve 60 is at the lowest position (Ls=0), the spring force Fsϕ acting on the shuttle valve 60 is Fs=k * (Xϕ+X1). When the shuttle valve 60 is at the highest position (Ls=X1), the spring force Fs1 acting on the shuttle valve 50 is Fs1=k * Xϕ.

Accordingly, in maximum capacity operation, Fp≧Fsϕ, and the shuttle valve 60 is located at the lowest position. In minimum capacity operation, Fp≦Fsϕ, and the shuttle valve 60 is located at the highest position. In capacity control operation, Fp=Fs, and the shuttle valve 60 is balanced at the intermediate position.

Figure 6:
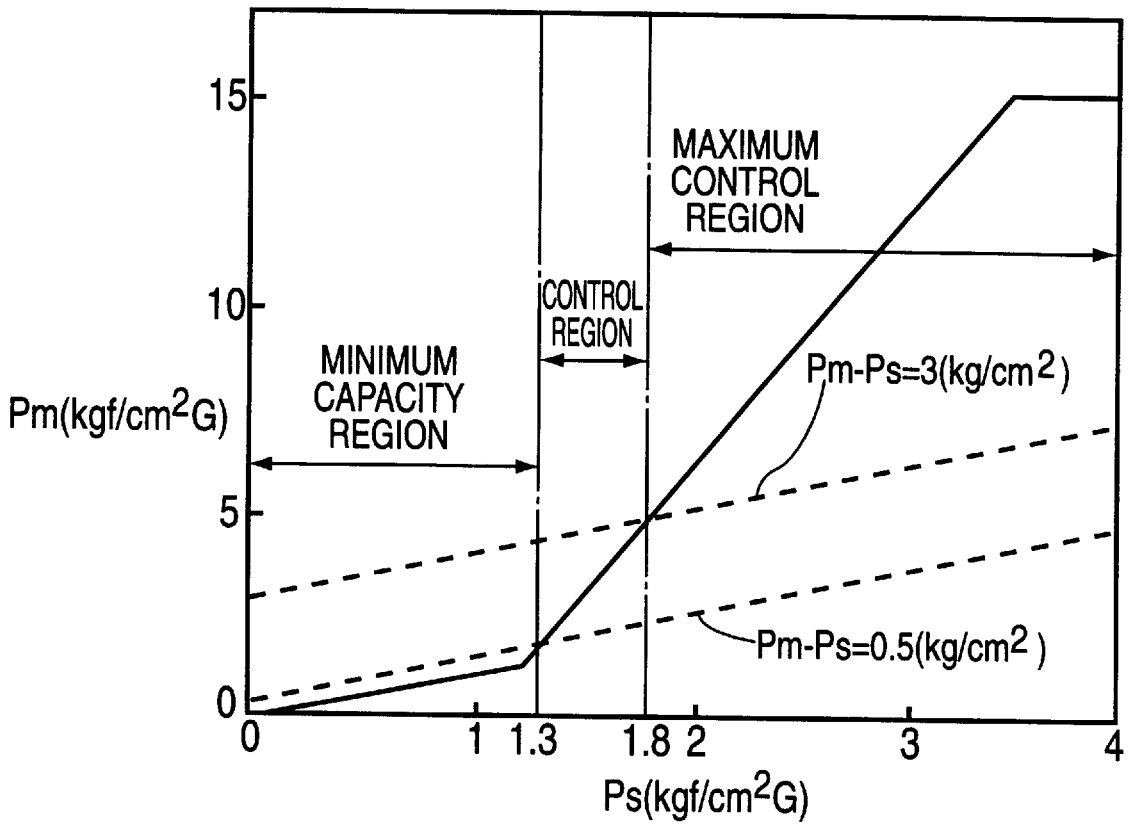
FIG. 6 is a graphical diagram of the relationship between the control pressure and the suction pressure in the preferred embodiment.

The pressure characteristics (Pm−Ps characteristics) of the pressure control valve 70 are shown in the graphical representation of FIG. 6. For example, when the intermediate pressure Pc is 15 [kgf/cm$^2$], the load characteristics of the spring 62 are represented by the following relationship:

Fsϕ/Sv=3.0 [kgf/cm$^2$]; and $Fs1/Sv=0.5$ [kgf/cm$^2$].

When the cooling load is high, the suction pressure Ps rises, and the control pressure Pm increases. In FIG. 6, when reaching Ps @ 1.8 [kgf/cm$^2$], it follows that:

$Pm-Ps \geqq 3$ [kgf/cm$^2$] ($=Fs\phi/Sv$).

That is, $Fp \geqq Fs\phi$, and the shuttle valve 60 is urged to the lowest position to achieve the maximum capacity operation and increased cooling capacity.

To the contrary, when the cooling load is low, the suction pressure Ps drops, thereby reducing the control pressure Pm. At $Ps \leqq 1.3$ [kgf/cm$^2$], it follows that $Fp \leqq Fs1$, and the shuttle valve 60 is biased into the highest position to be in minimum capacity operation, thereby lowering the cooling capacity.

At 1.8 [kgf/cm$^2$]$\leqq Ps \leqq 1.3$ [kgf/cm$^2$], the region for capacity control operation, the control function operates to stabilize the suction pressure Ps at an optimum value depending upon the cooling capacity.

When the compressor is stopped, the intermediate pressure Pc decreases, and accordingly, the control pressure Pm is reduced until Pm is nearly equal to Ps. As a result, Fp becomes nearly equal to 0 [kgf/cm$^2$], consequently causing the shuttle valve 60 to be urged into the highest position, and all the bypass holes to open. Therefore, subsequent start up begins at the minimum compressor capacity, reducing the starting shock and ensuring a smooth starting effect.

In order to prevent back flow of the compressed fluid from the upstream side fluid pocket to the downstream side fluid pocket, and to instead, assure that such fluid is bypassed only to the suction chamber, bypass holes 5*a*, 50*b*, 51*a*, 51*b* and 52*a* and 52*b* each have a diameter less than or equal to the width of the upstanding spiral wraps extending from the orbiting end plate, as best shown in the drawing of FIGS. 2 and 3. As long as the diameter of each bypass hole is less than or equal to the width of a spiral wrap, a by-pass hole can only communicate with the compressed fluid on one side of a spiral wrap at a time thereby preventing the back flow of compressed fluid from one side of a wrap to the other. If a cross-sectional area larger than that corresponding to a single bypass hole of a diameter less than or equal to the thickness of the spiral wrap is required, two or more bypass holes can be utilized, with each hole once again having a diameter equal to or less than the thickness of the wraps and positioned to be covered by the spiral wrap simultaneously.

In view of the foregoing description, the invention provides a variable capacity control mechanism for a scroll compressor that is wholly disposed in the fixed end plate of the fixed scroll with a minimum number of components to provide a simple structure which may be fabricated at low cost.

According to a further aspect of the invention, the bypass communication passage from each group of bypass holes operates independently, such that the variable capacity control operation can be effected at high efficiency.

Yet another aspect of the invention incorporates a pressure control valve into the fixed end plate, to allow for reducing the overall size of the compressor.

Still another aspect of the invention resides in placing the control pressure passage on the back side of the fixed end plate to enhance performance by reducing control fluid pressure losses.

The present invention has been shown and described in what is considered to be the most practical and preferred embodiment. It is anticipated, however, that departures may be made therefrom and that obvious modifications will occur to persons skilled in the art.

What is claimed is:

1. In a variable capacity control scroll compressor comprising: a compressor housing; a fixed scroll having a fixed end plate and a spiral wrap extending from said fixed end plate; an orbiting scroll having an orbiting end plate defining a back side and a front side, said front side having an upstanding spiral wrap extending from said orbiting end plate, said wraps of said fixed scroll and said orbiting scroll being intermeshed to define a plurality of fluid compression pockets, and positioned to receive fluid to be compressed from a suction chamber in said housing said fixed scroll and said orbiting scroll being disposed inside of said compressor housing; means for imparting orbiting motion to said orbiting scroll relative to said fixed scroll; anti-rotation means for preventing rotation of said orbiting scroll when said orbiting scroll orbits relative to said fixed scroll; wherein said scroll compressor compresses a working fluid from the outer circumference of both of said wraps inwardly towards a discharge port in said fixed end plate while forming a closed fluid pocket between said wraps by the orbiting motion of said orbiting scroll and a discharge valve at the discharge port on said fixed end plate; an improved variable capacity mechanism, comprising:

said fixed end plate defining at least a pair of fluid bypass holes therethrough positioned with respect to said spiral wrap extending from said fixed end plate to enable communication with at least a corresponding pair of fluid pockets being compressed simultaneously at equal positions with respect to the shape of the fluid pockets;

a cylinder formed in said end plate and adapted to communicate with said fluid pockets through said bypass holes respectively;

a reciprocating shuttle valve slidably disposed in said cylinder to thereby vary the opening area of said bypass holes to continuously change the discharge capacity of said scroll compressor by variably communicating compressed fluid back to said outer circumference of said wraps; and a control valve for controlling the reciprocation of said shuttle valve responsive to a control pressure Pm.

2. The variable capacity control scroll compressor of claim 1, wherein said pressure control valve communicates said control pressure Pm to said shuttle valve via a passageway defined in said cylinder such that said control pressure is applied to a first side of said shuttle valve, said shuttle valve being spring-loaded with respect to a second side thereof such that reciprocating shuttle valve translation within said cylinder is effected by a net force applied to said shuttle valve as a result of said control pressure and said spring-loading.

3. The variable capacity control scroll compressor of claim 1, wherein said pressure control valve is disposed in said fixed end plate and said control pressure Pm is responsive to variations in suction pressure Ps.

4. The variable capacity control scroll compressor of claim 3, wherein said compressor housing is divided into a front housing and rear plate, and a passage for supplying said control pressure from said pressure control valve is formed between said back side of said fixed end plate and said rear plate through an O-ring.

5. In a variable capacity control scroll compressor comprising: a compressor housing; a fixed scroll having a fixed end plate and a spiral wrap extending from said fixed end plate; an orbiting scroll having an orbiting end plate defining a back side and a front side, said front side having an upstanding spiral wrap extending from said orbiting end plate, said wraps of said fixed scroll and said orbiting scroll being intermeshed to define a plurality of fluid compression pockets and being positioned to receive fluid to be compressed from a suction chamber, said fixed scroll and said orbiting scroll being disposed inside of said compressor housing; means for imparting orbiting motion to said orbiting scroll relative to said fixed scroll; anti-rotation means for preventing rotation of said orbiting scroll when said orbiting scroll orbits relative to said fixed scroll; wherein said scroll compressor compresses a working fluid from the outer circumference of both of said wraps inwardly towards a discharge port in said fixed end plate while forming a closed fluid pocket between said wraps by the orbiting motion of said orbiting scroll; an improved variable capacity mechanism, comprising:

said fixed end plate defining at least a pair of fluid bypass holes therethrough positioned with respect to said spiral wrap extending from said fixed end plate to enable communication with at least a corresponding pair of fluid pockets being compressed simultaneously at equal positions with respect to the shape of the fluid pockets;

a single axially elongated cylinder formed in said end plate and adapted to communicate with said fluid pockets through said bypass holes, respectively;

a reciprocating shuttle valve slidably disposed in said cylinder to thereby vary the opening area of said bypass holes to continuously change the discharge capacity of said scroll compressor by communicating compressed fluid back to said suction chamber; and a control valve for supplying a control pressure Pm to said shuttle valve to enable operation thereof in response to variations in suction pressure Ps, said control valve being integral with said fixed end plate.

6. The variable capacity control scroll compressor recited in claim 5, wherein said control valve communicates said control pressure Pm to said shuttle valve via a passageway defined in said cylinder such that said control pressure is applied to a first side of said shuttle valve, said shuttle valve being spring-loaded with respect to a second side thereof such that reciprocating shuttle valve translation within said cylinder is effected by a net force applied to said shuttle valve as a result of said control pressure and said spring-loading.

7. The variable capacity control scroll compressor recited in claim 6, wherein said shuttle valve has an outer circumference and at least one recess defined in said outer circumference, said shuttle valve further defining a fluid passageway therein communicating fluid through said shuttle valve from said at least one recess via at least one port defined in said at least one recess of said shuttle valve, said fixed end plate defining a passageway for communicating between said suction chamber and said fluid passageway in said cylinder.

8. The variable capacity control scroll compressor recited in claim 7, wherein a first recess is located relative to said shuttle valve proximal to a first group of bypass holes defined in said fixed end plate and a second recess is located relative to said shuttle valve proximal to a second group of bypass holes defined in said fixed end plate near said discharge port when said shuttle valve is disposed in a bypass position so as to facilitate fluid bypass through said first and second groups of bypass holes.

9. The variable capacity scroll compressor recited in claim 5, wherein said bypass holes have a diameter less than or equal to the width of said wraps.

10. In a variable capacity control scroll compressor comprising: a compressor housing; a fixed scroll having a fixed end plate and a spiral wrap extending from said fixed end plate; an orbiting scroll having an orbiting end plate defining a back side and a front side, said front side having an upstanding spiral wrap extending from said orbiting end plate, said wraps of said fixed scroll and said orbiting scroll being intermeshed to define a plurality of fluid compression pockets and being positioned to receive fluid to be compressed from a suction chamber, said fixed scroll and said orbiting scroll being disposed inside of said compressor housing; means for imparting orbiting motion to said orbiting scroll relative to said fixed scroll; anti-rotation means for preventing rotation of said orbiting scroll when said orbiting scroll orbits relative to said fixed scroll; wherein said scroll compressor compresses a working fluid from the outer circumference of both of said wraps inwardly towards a discharge port in said fixed end plate while forming a closed fluid pocket between said wraps by the orbiting motion of said orbiting scroll; an improved variable capacity mechanism, comprising:

said fixed end plate defining at least a pair of fluid bypass holes therethrough positioned with respect to said spiral wrap extending from said fixed end plate to enable communication with at least a certain pair of fluid pockets being compressed simultaneously at equal positions with respect to the shape of the fluid pockets;

a single axially elongated cylinder formed in said end plate and adapted to communicate with said fluid pockets through said bypass holes, respectively;

a reciprocating shuttle valve slidably disposed in said cylinder to thereby vary the opening area of said bypass holes to continuously change the discharge capacity of said scroll compressor by communicating compressed fluid back to said suction chamber, said shuttle valve being spring-loaded with respect to a second side thereof such that shuttle valve translation within said cylinder is effected by a net force applied to said shuttle valve as a result of a control pressure Pm and said spring-loading, wherein said shuttle valve has an outer circumference and at least one recess defined in said outer circumference, said shuttle valve further defining a fluid passageway therein communicating fluid through said shuttle valve from said at least one recess via at least one port defined in said at least one recess of said shuttle valve, said fixed end plate defining a passageway for communicating between said suction chamber and said fluid passageway in said cylinder; and a control valve for supplying a control pressure Pm to said shuttle valve to enable operation thereof in response to variations in suction pressure Ps, said control valve being integral with said fixed end plate wherein said control valve communicates said control pressure Pm to said shuttle valve via a passageway defined in said cylinder such that said control pressure is applied to a first side of said shuttle valve.

11. In a variable capacity control scroll compressor comprising: a compressor housing; a fixed scroll having a fixed end plate and a spiral wrap extending from said fixed end plate; an orbiting scroll having an orbiting end plate defining a back side and a front side, said front side having an upstanding spiral wrap extending from said orbiting end plate, said wraps of said fixed scroll and said orbiting scroll being intermeshed to define a plurality of fluid compression pockets and being positioned to receive fluid to be compressed from a suction chamber, said fixed scroll and said orbiting scroll being disposed inside of said compressor housing; means for imparting orbiting motion to said orbiting scroll relative to said fixed scroll; anti-rotation means for preventing rotation of said orbiting scroll when said orbiting scroll orbits relative to said fixed scroll; wherein said scroll compressor compresses a working fluid from the outer circumference of both of said wraps inwardly towards a discharge port in said fixed end plate while forming a closed fluid pocket between said wraps by the orbiting motion of said orbiting scroll; an improved variable capacity mechanism, comprising:

said fixed end plate defining at least a pair pairs of fluid bypass holes therethrough positioned with respect to said spiral wrap extending from said fixed end plate to enable communication with at least corresponding pairs of fluid pockets being compressed simultaneously at equal positions with respect to the shape of the fluid pockets;

a single axially elongated cylinder formed in said end plate and adapted to communicate sequentially with said pairs of fluid pockets through said pairs of bypass holes, respectively;

a reciprocating shuttle valve slidably disposed in said cylinder to thereby vary the number of pairs of said bypass holes opened to continuously change the discharge capacity of said scroll compressor by communicating compressed fluid back to said suction chamber; and a control valve for supplying a control pressure Pm to said shuttle valve to enable operation thereof in response to variations in suction pressure Ps, said control valve being integral with said fixed end plate.

12. The variable capacity control scroll compressor recited in claim 11, wherein said control valve communicates said control pressure Pm to said shuttle valve via a passageway defined in said cylinder such that reciprocating shuttle valve translation within said cylinder causes said shuttle valve to sequentially communicate with first pair of fluid bypass holes and a second paid of fluid bypass holes.

* * * * *